US006880274B2

(12) United States Patent
Liu

(10) Patent No.: US 6,880,274 B2
(45) Date of Patent: Apr. 19, 2005

(54) CRYSTAL BALL STRUCTURE DELIVERING VIRTUAL SNOWFALL SCENE AND LIGHT EFFECT

(76) Inventor: Jack Liu, 3F., 200, Sin-Yi Rd., Sec. 3, Taipei 106 (TW)

( * ) Notice: Subject to any disclaimer, the term of this patent is extended or adjusted under 35 U.S.C. 154(b) by 0 days.

(21) Appl. No.: 10/235,722

(22) Filed: Sep. 6, 2002

(65) Prior Publication Data

US 2004/0045198 A1 Mar. 11, 2004

(51) Int. Cl.[7] ..... G09F 19/00
(52) U.S. Cl. ..... 40/410; 40/406
(58) Field of Search ..... 40/406, 409, 410, 40/411, 414, 426; 428/11

(56) References Cited

U.S. PATENT DOCUMENTS 4,641,445 A * 2/1987 Rossi ..... 40/410
4,817,311 A * 4/1989 Ong S. T. ..... 40/410
4,961,276 A * 10/1990 Lin ..... 40/410
5,666,750 A * 9/1997 Segan et al. ..... 40/410
5,778,576 A * 7/1998 Kaviani ..... 40/409
5,864,976 A * 2/1999 Yang ..... 40/410
6,161,317 A * 12/2000 Wang ..... 40/406
6,269,566 B1 * 8/2001 Lo ..... 40/406
6,357,151 B1 * 3/2002 Yuen ..... 40/406
6,415,535 B1 * 7/2002 White et al. ..... 40/410
6,508,022 B1 * 1/2003 Huang ..... 40/426
6,588,130 B1 * 7/2003 Yang ..... 40/410

* cited by examiner

*Primary Examiner*—Lars A. Olson
(74) *Attorney, Agent, or Firm*—Dennison Schultz Dougherty & MacDonald

(57) ABSTRACT

This invention relates to a crystal ball structure that delivers virtual snowfall scene and light effect, comprising of a crystal ball enclosing a thematic sight and liquid, a seat to support the crystal ball and contain a drive mechanism, an agitating mechanism that can rotate to stir the liquid, and a light to enhance the decoration effect. Under the drive of the dynamic drive mechanism, a gear train and an agitating mechanism, which is powered from a manually fastened spring, the fans of the agitating mechanism agitates the liquid to stir the floating matter dispersed in the liquid and generate a virtual scene of snowfall scene under the reflection of the light.

4 Claims, 4 Drawing Sheets

CRYSTAL BALL STRUCTURE DELIVERING VIRTUAL SNOWFALL SCENE AND LIGHT EFFECT

FIELD OF INVENTION

This invention relates to a crystal ball structure that delivers virtual snowfall scene and light effect, comprising of a crystal ball enclosing a thematic sight and liquid, a seat to support the crystal ball and contain a drive mechanism, an agitating mechanism that can rotate to stir the liquid, and a light to enhance the decoration effect. Under the drive of the dynamic drive mechanism, a gear train and an agitating mechanism, which is powered from a manually fastened spring, the fans of the agitating mechanism agitates the liquid to stir the floating matter dispersed in the liquid and generate a virtual scene of snowfall scene under the reflection of the light.

BACKGROUND OF INVENTION

A crystal ball can be used as an ornament on desktops or in cabinets in homes or offices. The crystal ball filled with liquid generates a convex lens effect, highlighting the trees, houses, castles, characters and such models in it. If some paillettes are added in the crystal ball, the paillettes will fall down slowly when the crystal ball is swayed top and down and then placed back, generating a virtual snowfall scene. Moreover, a spring can be mounted in the seat and when it is fastened and then released, the crystal ball can play some music. Together with some decoration of light, the entire ornament will deliver a dynamic scene, music and light effects together.

As described above, in traditional dynamic scene ornaments (i.e., crystal balls), the entire crystal ball have to be turned over or swayed top and down and then placed back to generate the a snowfall scene. However, such a dynamic scene can't last long and disappears with the deposition of paillettes. If you want to see the scene again, you must do the above things again.

The inventor doesn't plan to add some power source to such an ornament of dynamic scene to keep the scene on because that a power source mechanism will add cost and weight to the ornament. Instead, the inventor utilizes the spring in a music box in the seat for the crystal ball to generate mechanical energy when the spring is fastened. Then, the mechanical energy is transferred to an agitating mechanism through a drive part and gear train to agitate the liquid in the crystal ball and keep the paillettes floating. However, the key task of this invention is how to transfer the power to the agitating mechanism.

On the basis of years of experience in design of dynamic scene ornaments, the inventor invents a crystal ball structure delivering virtual snowfall and light effect through experimentation and development.

SUMMARY OF INVENTION

The object of the present invention is to provide a crystal ball structure that delivers virtual snowfall scene and light effect, comprising of a crystal ball enclosing a thematic sight and liquid, a seat to support the crystal ball and contain a drive mechanism, an agitating mechanism that can rotate to stir the liquid, and a light to enhance the decoration effect. Under the drive of the dynamic drive mechanism, a gear train and an agitating mechanism, which is powered from a manually fastened spring, the fans of the agitating mechanism agitates the liquid to stir the floating matter dispersed in the liquid and generate a virtual scene of snowfall scene under the reflection of the light.

The structure, efficacy, and purpose of this invention is detailed further in the following illustrations and description.

DETAILED DESCRIPTIONS OF EMBODIMENTS

Figure 1:
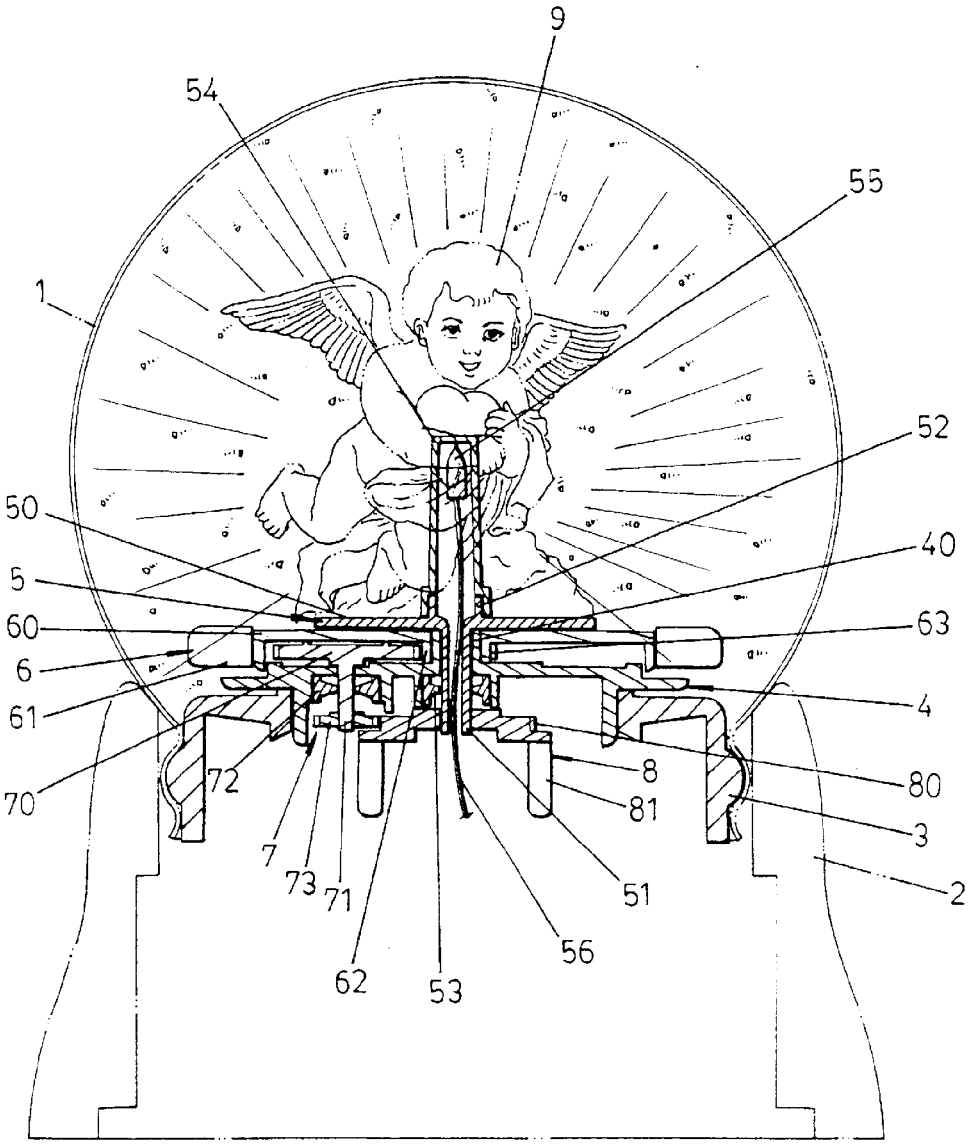
FIG. 1 is a sectional view of the first embodiment implemented according to this invention.

Please refer to FIG. 1, a sectional view of the first embodiment implemented according to this invention. The gear chain, agitating mechanism, light, and thematic model are all mounted on the fixing plate, which has a cylinder extending downwards. The outer skirt of the cylinder and a rubber plug is melted with ultrasonic amalgamation and ultrasonic conglutinated together. The opening of the crystal ball 1 is put onto the seat 2 and sealed together. After the crystal is filled with liquid, a rubber plug 3 is plugged into the opening of the crystal ball 1 by force to prevent the liquid from leaking out.

There is a neck structure 40 at the center of the fixing plate 4 extending upwards. Inside the neck 40, there is a model container 5. And there is an agitating mechanism 6 at the outside of the neck 40.

The model container 5 has a surface 50, where the thematic model, a long tube 51 extending downwards, and a short tube 52 extending upwards is fixed. The long tube 51 runs through the neck 40 of the fixing plate 4 and is equipped with a seal ring 53 to avoid leakage. The short tube 52 is connected to a transparent tube 54 on the top. The transparent tube contains a luminous element 55 as the light source of this invention. The power lead 56 of the luminous element 55 extends through the transparent tube 55, and the hollow tube where the short tube 52 and the long tube 51 run though, and is connected to the power supply unit (not shown).

The agitating mechanism 6 is located between the fixing plate 4 and the container 5. It comprises of a plate 60 and fans 61 on the circumference of the plate 60. There is a shaft hole 62 at the center of the plate 60, and the inside of the shaft hole 62 is fixed over the outside of the neck 40 of the fixing plate 4. There is a gear rack 63 outside of the shaft hole 62.

The first gear 70 of the gear train 7 is coupled with said gear rack 63 that is located at the outside of the shaft hole 62 of the agitating mechanism 6. The shaft 71 of the first gear 70 passes through the through-hole of the fixing plate 4 and is equipped with a seal ring 72, and it is coupled with the second gear 73 of the gear train 7 on the other end. The second gear 73 is coupled with the driving gear 80 of the driving part 8.

The center hole of the driving part 8 is fixed on the bottom end of the long tube 51 of said model container 5, and it has the driving gear 80 coupled with the second gear 73 and a driving arm 81 extending downwards. The driving arm 81 rotates under the drive of the spring, which is manually fastened (not shown for stock-in-trade).

When the driving arm 81 of the driving part 8 rotates under the drive of the spring, the model container 5 fixing with the driving part 8 drives the thematic model 9 to rotate; and at the same time, the driving gear 80 of the driving part 8 transfers the motion to the second gear 73, the first gear 70, and the gear rack 63 around the shaft hole 62 of the agitating mechanism 6, which in turn rotates and stirs the liquid with its fans 61. In this way, the paillettes will run down and up along with the liquid, generating a snowfall effect.

As the paillettes runs down and up, the luminous element 55 hiding in the thematic model radiates light and the music is played. Thus, the viewer can enjoy the beautiful scene of snowfall accompanied with euphonic music and decorative light.

Figure 2:
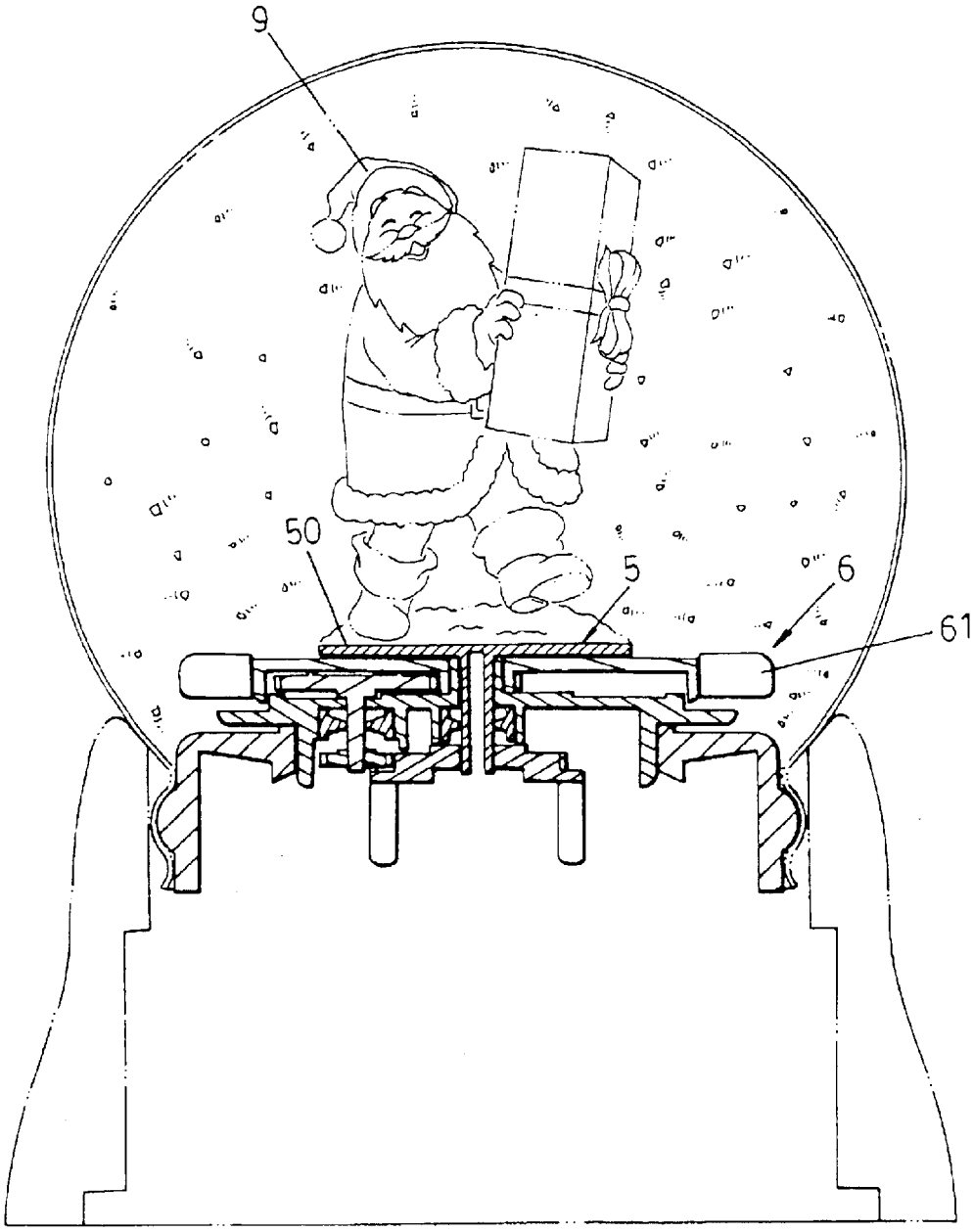
FIG. 2 is a sectional view of the second embodiment implemented according to this invention.

Please refer to FIG. 2, a sectional view of the second embodiment implemented according to this invention. The difference to the first embodiment is: In that embodiment, the short cube on the surface 50 of the model container 5 that is used to fix the thematic model 9 is omitted, that is to say, the surface 50 of the model container 5 is a plane. In this way, the luminous element and relevant parts can be omitted. However, the agitating mechanism 6 and its fans 61 are kept down. In other words, in the second embodiment, only the stir action generated from the fans 61 of the agitating mechanism 6 is kept down, which drives the liquid to flow continuously, and the paillettes can run down and up. Thus the viewer can still enjoy the scene of virtual snowfall, but the decoration of light is omitted. The purpose of this embodiment is to make the invention more flexible in design to adaptable to actual cases such as the thematic unsuitable to the light or the cost of the invention.

Figure 3:
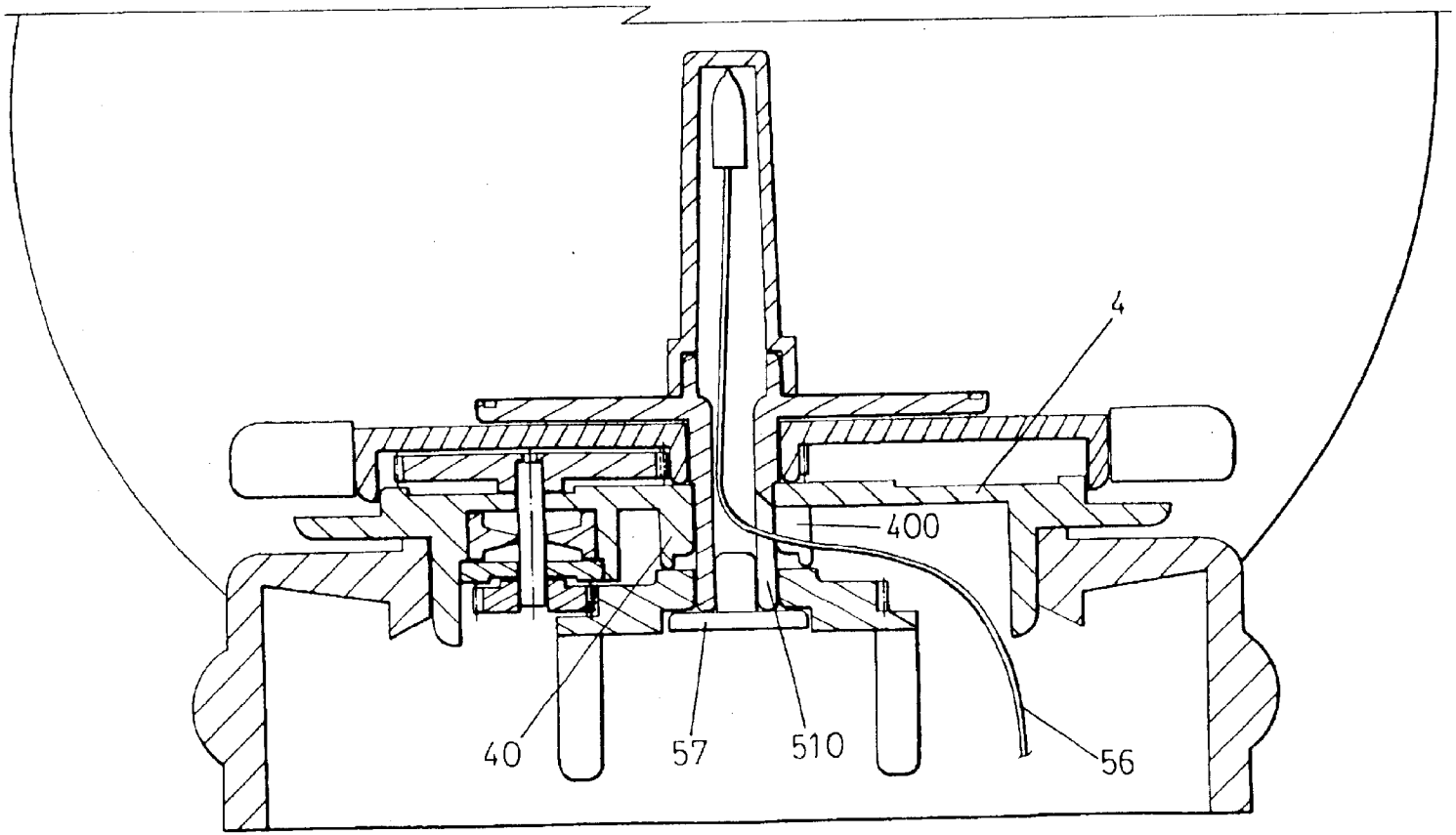
FIG. 3 is a sectional view of the third embodiment implemented according to this invention.

Please refer to FIG. 3, a sectional of the third embodiment implemented according to this invention. The difference to the first embodiment is: In that embodiment, the long tube 51 extending downwards through the center hole of the driving part 8 and the model container 5 is detachable, and a plug 57 is plugged into the bottom end of the long tube 51 to avoid leakage and falling off of the driving part 8. However, because the bottom end of the long tube 51 is blocked with the plug 57, a notch 510 is carved near the bottom of the long tube 51 to let the power lead 56 of the luminous element 55 contacts with power. And another notch 400 is carved on the neck 40 of the fixing plate 4, adjacent to the long tube 51, to let the power lead 56 of the luminous element 55 run through the transparent tube 55, the short tube 52, the notch 510 on the long tube 51, and the notch 400 on the neck 40 of the fixing plate 4 to reach to the power supply. Because the long tube 51 is flexible attached, the driving part 8 will not drive the model container 5 to rotate. That is to say, the stir action generated from the fans 61 of the agitating mechanism 6 is kept down, and the decoration effect from the luminous element is also inherited. The viewer can enjoy the scene of virtual snowfall with the light decoration.

Figure 4:
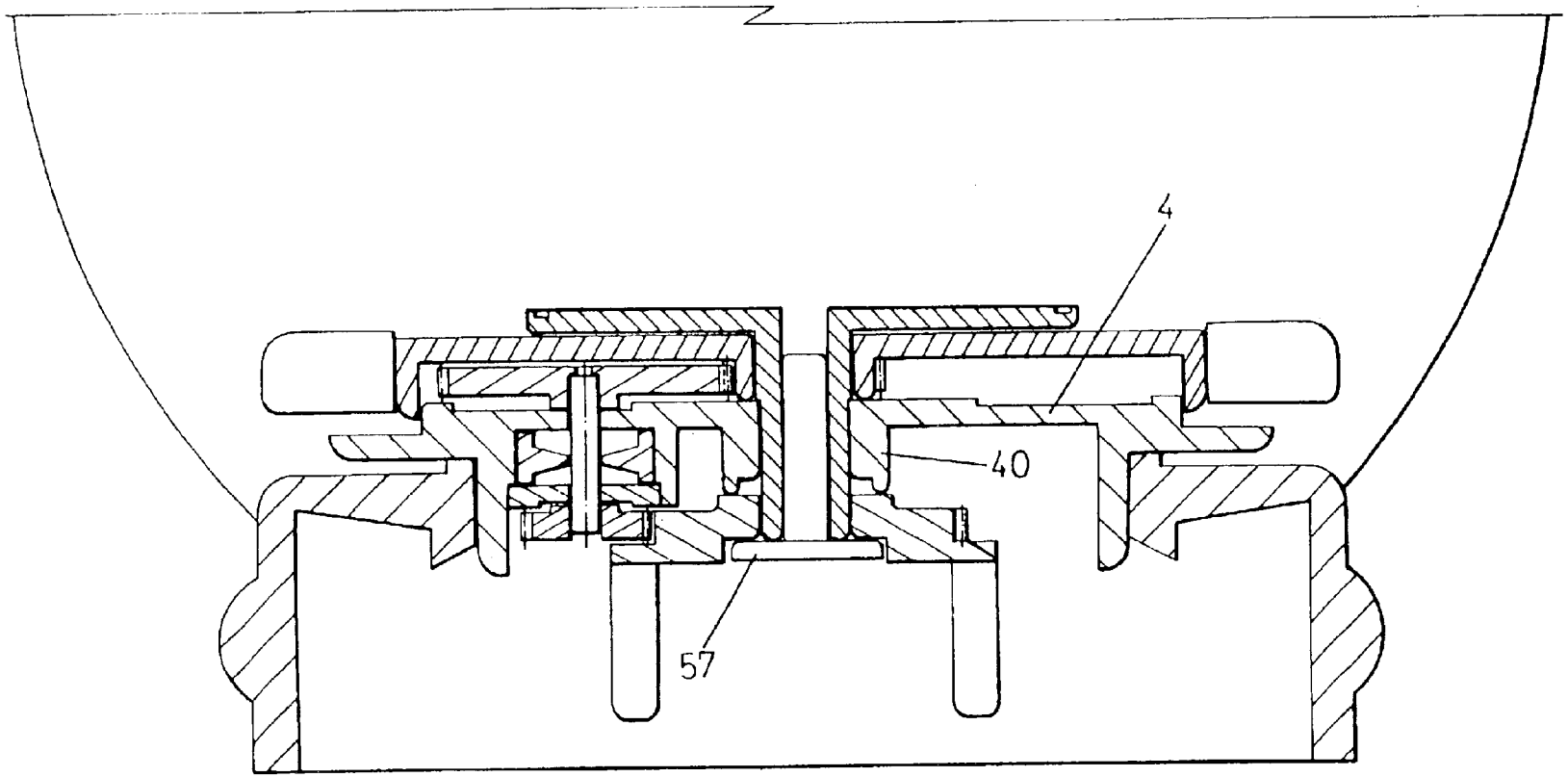
FIG. 4 is a sectional view of the fourth embodiment implemented according to this invention.

Please refer to FIG. 4, a sectional view of the fourth embodiment implemented according to this invention. The difference to the third embodiment is: In that embodiment, the short cube on the surface 50 of the model container 5 that is used to fix the thematic model is omitted, that is to say, the surface 50 of the model container 5 is a plane. In this way, the luminous element and relevant parts can be omitted. However, the agitating mechanism 6 and its fans 61 are kept down. In other words, in the fourth embodiment, only the stir action generated from the fans 61 of the agitating mechanism 6 is kept down, which drives the liquid to flow continuously, and the paillettes can run down and up. Thus the viewer can still enjoy the scene of virtual snowfall, but the decoration of light is omitted. Therefore, the notches 510 and 400 in the third embodiment are unnecessary here.

In conclusion, this invention utilizes a manually fastened spring of a music box to drive the liquid in a crystal ball through the driving mechanism, in order to drive the paillettes running down and up along with the flow of the liquid to generate a scene of virtual snowfall together with optional light decoration. It delivers dynamic/static scenes, graceful music, and light decoration without additional dynamic power supply. Such an invention can really be deemed as an innovative improvement. Thus the inventor applies for a new patent with it.

What is claimed is:

1. A crystal ball structure that delivers a virtual snowfall scene and light effect, comprising a seat and a crystal ball on the seat, a thematic model and a liquid in the crystal ball; a rubber plug and a bottom opening of the crystal ball blocked with the rubber plug to avoid leakage, and a fixing plate and a fixed cylinder and the rubber plug is fixed in the fixed cylinder extending from the fixing plate; characterized in that:

said fixing plate has a neck extending upwards at the center, which has a model container inside and an agitating mechanism outside, wherein the model container is designed to fix said thematic model with a surface, a long tube extending downwards, and a short tube extending upwards; the long tube runs through the neck of said fixing plate and is equipped with a seal ring to avoid leakage; the short tube is connected to a transparent tube on the top, which contains a luminous element as a light source;

a gear rack and an agitating mechanism located between the fixing plate and the model container; the agitating mechanism comprising a plate and fans on the circumference of the plate; and a shaft hole at the center of the plate, and the plate is fixed over the neck of the fixing plate through the hole; and with the gear rack outside of the hole;

a driving part, a gear train and a first gear of the gear train having a shaft and coupled with the gear rack that is at the outside shaft hole of said agitating mechanism; a second gear and the shaft of the first gear passes through the through-hole of the fixing plate and is equipped with a seal ring, and it is coupled with the second gear of the gear train on the other end; the second gear is coupled with the gear of the driving part;

the center hole of the driving part is fixed on the bottom end of the long tube extending downwards along said model container, and it has a gear coupled with the second gear and a driving arm extending downwards;

a spring and the luminous element delivers decorated light of the thematic model by said instrument; when the driving arm of the driving part rotates under the drive of the spring, the driving part and the model container drives the thematic model to rotate, and at the same time, the gear of the driving part transfers the motion to the second gear, the first gear, and the gear rack around the shaft hole of the agitating mechanism, which in turn rotates and stirs the liquid with its fans.

2. A crystal ball structure that delivers a virtual snowfall scene, comprising a seat and a crystal ball on the seat, a thematic model, and a liquid in the crystal ball; a rubber plug and a bottom opening of the crystal ball blocked with the rubber plug to avoid leakage, and a fixing plate, a fixed cylinder and the rubber plug is fixed in the fixed cylinder extending from the fixing plate; characterized in that:

said fixing plate has a neck extending upwards at the center, which has a model container inside and an agitating mechanism outside, wherein the model container is designed to fix said thematic model with a surface and a long tube extending downwards; the long tube runs through the neck of said fixing plate and is equipped with a seal ring to avoid leakage;

a gear rack and an agitating mechanism located between the fixing plate and the model container comprising a plate and fans on the circumference of the plate; and a shaft hole at the center of the plate, and the plate is fixed over the neck of the fixing plate through the hole; with the gear rack outside of the hole;

a driving part, a gear train and a first gear of the gear train is having a shaft and coupled with the gear rack that is at the outside shaft hole of said agitating mechanism; a second gear and the shaft of the first gear passes through the through-hole of the fixing plate and is equipped with a seal ring, and it is coupled with the second gear of the gear train on the other end; the second gear is coupled with the gear of the driving part; the center hole of the driving part is fixed on the bottom end of the long tube extending downwards along said model container, and it has a gear coupled with the second gear and a driving .arm extending downwards;

when the driving arm of the driving part rotates under the drive of a spring, the driving part and the model container drives the thematic model to rotate, and at the same time, the gear of the driving part transfers the motion to the second gear, the first gear, and the gear rack around the shaft hole of the agitating mechanism, which in turn rotates and stirs the liquid with its fans.

3. A crystal ball structure that delivers a virtual snowfall scene and light effect, comprising a seat and a crystal ball on the seat, a thematic model, and a liquid in the crystal ball; a rubber plug and a bottom opening of the crystal ball is blocked with the rubber plug to avoid leakage, and a fixing plate, a fixed cylinder and the rubber plug is fixed in the fixed cylinder extending from a the fixing plate; characterized in that:

said fixing plate has a neck extending upwards at the center, which has a model container inside and a notch at an appropriate position to let the lead of a luminous element pass through; wherein the model container is designed to fix said thematic model with a surface, a long tube extending downwards, and a short tube extending upwards; the long tube runs through the neck of said fixing plate, is flexibly attached to a driving part, and is equipped with a seal ring to avoid leakage; the long tube also has a notch against the notch on the neck to let the power lead of a luminous element pass through; the short tube is connected to a transparent tube on the top, which contains a luminous element as a light source;

a gear rack and an agitating mechanism located between the fixing plate and the model container comprising a plate and fans on the circumference of the plate and a shaft hole at the center of the plate, and the plate is fixed over the neck of the fixing plate through the hole with the gear rack outside of the hole;

a driving part, a gear train and a first gear of the gear train is having a shaft and coupled with the gear rack that is at the outside shaft hole of said agitating mechanism; a second gear and the shaft of the first gear passes through the through-hole of the fixing plate and is equipped with a seal ring, and it is coupled with the second gear of the gear train on the other end; the second gear is coupled with the gear of the driving part;

the driving part is fixed on the bottom end of the long tube, and it has a gear coupled with the second gear and a driving arm extending downwards; the driving arm rotates under the drive of the spring, which is manually fastened;

the luminous element delivers decorated light of the thematic model by said instrument; when the driving arm of the driving part rotates under the drive of a spring, the model container that contacts with the driving part will not drive the thematic model to rotate, however, the gear of the driving part transfers the motion to the second gear, the first gear, and the gear rack around the shaft hole of the agitating mechanism, which in turn rotates and stirs the liquid with its fans.

4. A crystal ball structure that delivers a virtual snowfall scene, comprising of a seat and a crystal ball on the seat, a thematic model, and a liquid in the crystal ball; a rubber plug and a bottom opening of the crystal ball blocked with the rubber plug to avoid leakage, and a fixing plate, a fixed cylinder and the rubber plug is fixed in the fixed cylinder extending from the fixing plate; characterized in that:

said fixing plate has a neck extending upwards at the center, which has a model container inside, wherein the model container is designed to fix said thematic model with a surface, a long tube extending downwards, and a short tube extending upwards; the long tube runs through the neck of the fixing plate and is contacted with a flexible part, plugged with a plug to avoid leakage;

a gear rack and an agitating mechanism located between the fixing plate and the model container comprising a plate and fans on the circumference of the plate and a shaft hole at the center of the plate, and the plate is fixed over the neck of the fixing plate through the hole; with the gear rack outside of the hole;

a driving part, a gear train and a first gear of the gear train having a shaft and coupled with the gear rack that is at the outside shaft hole of said agitating mechanism; a second gear and the shaft of the first gear passes through the through-hole of the fixing plate and is equipped with a seal ring, and it is coupled with the second gear of the gear train on the other end; the second gear is coupled with the gear of the driving part;

the driving part is fixed on the bottom end of the long tube, and it has a gear coupled with the second gear and a driving arm extending downwards; the driving arm rotates under the drive of a spring, which is manually fastened; and, when the driving arm of the driving part rotates under the drive of the spring, the model container that contacts with the driving part will not drive the thematic model to rotate, however, the gear of the driving part transfers the motion to the second gear, the first gear, and the gear rack around the shaft hole of the agitating mechanism, which in turn rotates and stirs the liquid with its fans.

* * * * *